US009788664B2

(12) United States Patent
Andren et al.

(10) Patent No.: US 9,788,664 B2
(45) Date of Patent: Oct. 17, 2017

(54) BABY CARRIER

(71) Applicant: BabyBjorn AB, Solna (SE)

(72) Inventors: Marten Andren, Spanga (SE); Ulrika Vejbrink, Hagersten (SE); David Thalen, Bromma (SE); Kim De Bruin Lyckman, Stockholm (SE)

(73) Assignee: BABYBJORN AB, Solna (SE)

( * ) Notice: Subject to any disclaimer, the term of this patent is extended or adjusted under 35 U.S.C. 154(b) by 0 days.

(21) Appl. No.: 13/937,420

(22) Filed: Jul. 9, 2013

(65) Prior Publication Data

US 2014/0014692 A1 Jan. 16, 2014

(30) Foreign Application Priority Data

Jul. 12, 2012 (SE) ..... 1250817

(51) Int. Cl.
*A47D 13/02* (2006.01)

(52) U.S. Cl.
CPC ..... *A47D 13/025* (2013.01)

(58) Field of Classification Search
CPC ..... A47D 13/025
USPC ..... 224/159, 160
See application file for complete search history.

(56) References Cited

U.S. PATENT DOCUMENTS

| | | | | |
|---|---|---|---|---|
| 5,961,014 | A * | 10/1999 | Knerr | 224/160 |
| 7,275,668 | B1 * | 10/2007 | Carroll | 224/190 |
| 7,343,880 | B2 * | 3/2008 | Bergkvist | A47D 13/025 119/770 |
| 8,417,899 | B2 * | 4/2013 | Roush | 711/152 |
| 8,636,181 | B2 * | 1/2014 | Gunter et al. | 224/160 |
| 2003/0121945 | A1 | 7/2003 | Lemanski, II | |
| 2004/0149790 | A1 | 8/2004 | Kassai et al. | |
| 2009/0206116 | A1 * | 8/2009 | Grant | 224/160 |
| 2009/0255965 | A1 | 10/2009 | Liljedahl et al. | |
| 2011/0101051 | A1 * | 5/2011 | Parness et al. | 224/160 |
| 2012/0061429 | A1 * | 3/2012 | Sauer | 224/160 |

* cited by examiner

*Primary Examiner* — Corey Skurdal
(74) *Attorney, Agent, or Firm* — Jacobson Holman, PLLC.

(57) ABSTRACT

A baby carrier includes chest straps, a waist belt, and a carrier bag mounted to the chest straps and the waist belt. The carrier bag has a front piece, with a lower portion of the front piece being connected to the waist belt. A connection between the chest straps is adapted to be achieved by an element, and a second part of the respective chest strap is connected to a middle portion of the front piece so as to permit the baby carrier to be rotated around an upper part of the body of a wearer. During one step of the rotation of the baby carrier, the element extends over one shoulder of the wearer and carries the weight which in the normal case is carried by the chest straps.

16 Claims, 7 Drawing Sheets

BABY CARRIER

BACKGROUND OF THE INVENTION

1. Field of Invention

The invention relates to a baby carrier according to the preamble of claim 1, and more particularly the invention relates to a rotatable baby carrier.

2. Description of the Prior Art

To be able to use a baby carrier during a longer period of time, i.e. for carrying an infant until it is about 24 months, alternatively about 36 months, it would be desirable if the baby carrier can be carried both on the chest side and the back side of a wearer, since, when a child gets heavier, it is advantageously carried on the back side of the wearer.

One problem with carrying a child on the back side of the wearer is that it is difficult to put the child into the carrier when the carrier is already placed on the back and you are alone, and that, in the case the child is already carried on the chest side, it is difficult to rotate/move the carrier from the chest side to the back side in a safely way.

Therefore, it would be desirable to have a baby carrier in which it is possible to position a child in the carrier when the carrier is carried on the chest side of the wearer, whereupon when the child is sitting safely in the carrier, the carrier may in a simple and for the child and the wearer safely way be rotated/moved by the wearer himself to the back sidec.

SUMMARY OF THE INVENTION

The object of the invention is thus to achieve a baby carrier which makes it possible to rotate/move the baby carrier in a way which is safe for both the child and the wearer from the chest side to the back side of the wearer and vice versa while the child sitting in the carrier.

According to the invention this is achieved by a baby carrier comprising chest straps, which are mutually adapted to extend around both shoulders of the wearer and connected to each other, a waist belt and a carrier bag mounted to the chest straps and the waist belt, the carrier bag comprises a front piece, a lower portion of the front piece is connected to the waist belt, characterized in that the connection between the chest straps is adapted to be achieved by a means, and a second part of respective chest strap is connected to a middle portion of the front piece so as to permit the baby carrier to be rotated around an upper part of the body of a wearer so as to move the baby carrier between a chest side and a back side of the wearer, whereby, during one step of the rotation of the baby carrier, the means extends over the shoulder of the wearer and carries the weight which in the normal case is carried by the chest straps.

Preferred embodiments are defined in the appending dependent claims.

BRIEF DESCRIPTION OF THE DRAWINGS

The invention is described in more detail below in the form of non-limited examples, reference being made to the appended drawings, in which.

DESCRIPTION OF PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the specification and the claims below the description of the baby carrier is to be understood such us that the baby carrier is carried on the chest side of the wearer if nothing else is stated.

Figure 1:
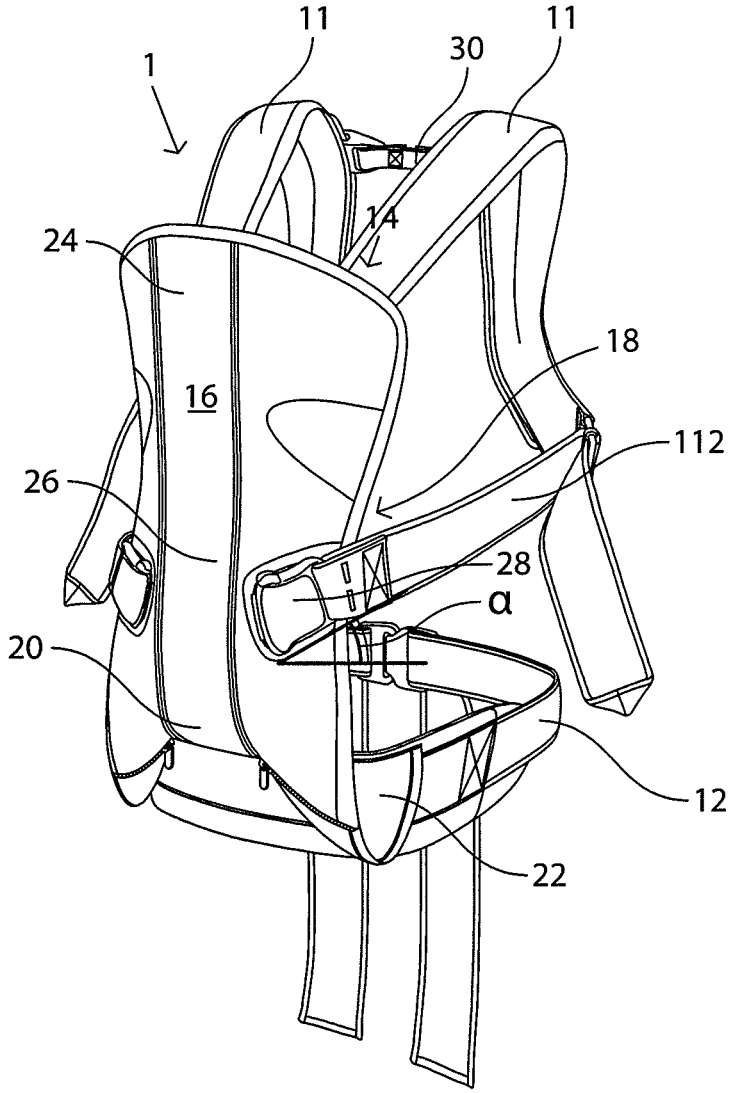
FIG. 1 is a schematic view seen obliquely from the front of a first embodiment of a baby carrier according to the invention.

FIG. 1 shows schematically a first embodiment of a baby carrier 1 according to the invention. The baby carrier 1 comprises adjustable chest straps 11, which are mutually adapted to extend around both shoulder areas 3 of the wearer 2 and are connected to each other on the back side of the wearer by a means 30. A carrier bag 14 is mounted on the chest straps and connected to a waist belt 12, preferably to an upper edge thereof, and comprises a front piece 16, whereby a carrier pouch 18 for a child is formed between the front piece and the body of the wearer. A lower portion 20 of the front piece is connected to the waist belt and forms a seat support 22 for a child sitting in the baby carrier. A second part 112 of respective chest strap 11 is attached to a middle portion 26 of the front piece 16, whereby preferably at least one second part 112 is detachably connected to the side of the front piece, preferably the front side, by a connecting device 28.

Figure 2:
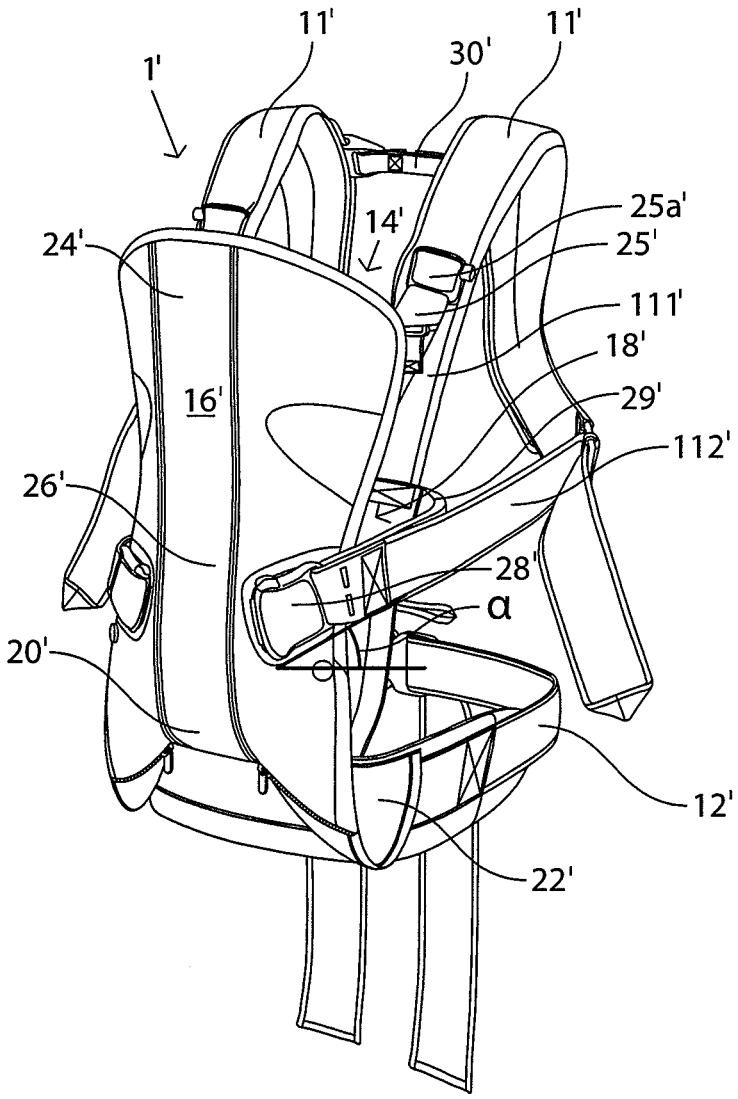
FIG. 2 is a schematic view seen obliquely from the front of a second embodiment of a baby carrier according to the invention.
Figure 3:
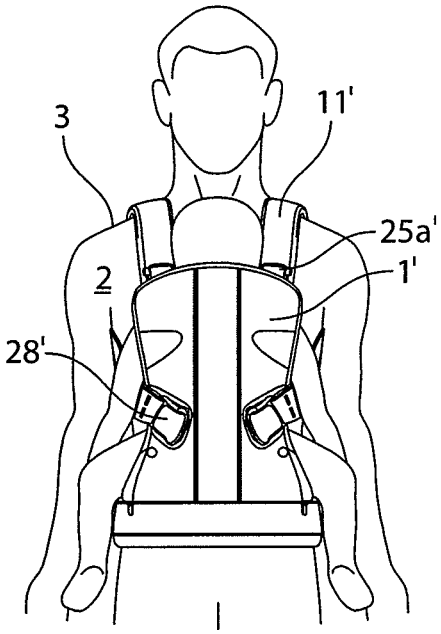
FIG. 3 is a schematic view seen from the front of a baby carrier according to the second embodiment carried by a wearer and with a baby sitting in the carrier with its face directed towards the wearer.

FIG. 2 shows schematically a second embodiment of a baby carrier 1' according to the invention. The baby carrier 1' comprises adjustable chest straps 11', which are mutually adapted to extend around both shoulder areas 3 of the wearer 2 and are connected to each other on the back side of the wearer by a means 30' and forms each in combination with a connecting means 29' a closed strap loop. An adjustable waist belt 12' is connected to a first part 111' of respective chest strap. A carrier bag 14' is mounted to the chest straps and to the waist belt, preferably to an upper edge thereof, and comprises a front piece 16' which together with at least the first part 111' of respective chest strap forms a carrier pouch 18'. A lower portion 20' of the front piece is connected to the waist belt and forms at least one seat support 22' for a child sitting in the baby carrier, which seat support may be adjustable in the height direction. An upper portion 24' of the front piece is detachably connected to the first part 111' of respective chest strap. The detachable connection of the upper portion can be achieved by a strap 25', for instance, which is adjustable in the longitudinal direction and which is attached to the inside of the upper portion 24' and which is detachably connected to respective chest strap 11' by a connecting device 25'*a*. A second part 112' of respective chest strap 11' is attached to a middle portion 26' of the front piece 16', whereby preferably at least one second part is detachably attached to the side of the front piece, preferably the front side, by a connecting device 28'. The second part 112' is connected through the connecting means 29', in the form of a strap or a piece of fabric, for instance, to the first part 111' of respective chest strap.

In the second embodiment of the invention the carrier pouch 18' is formed of the middle portion 26' of the front piece, the lower portion 20' of the front piece, the seat support 22' and at least the first part 111' of respective chest strap together with the connecting means 29'. The first part 111' of respective chest strap can be replaced by a flexible piece of fabric, for instance, which then can form an extension down to and a connection of the two chest straps to the waist belt.

Below, a baby carrier is described with reference to the second embodiment, but the only features which are different between the first and the second embodiments are how the carrier pouch 18;18' is formed and the possible existence thereof.

Figure 4:
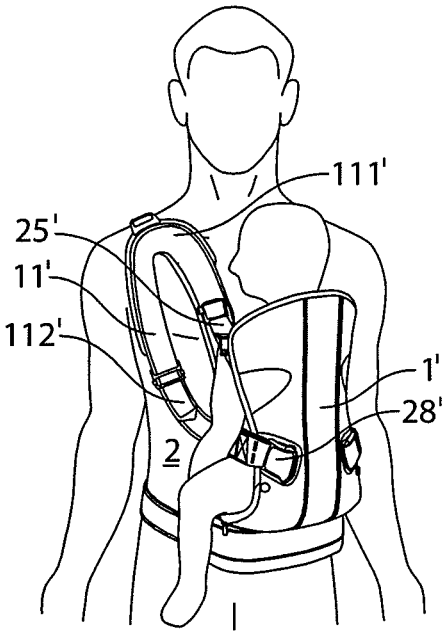
FIG. 4 is a schematic view of a wearer from the front with the baby carrier according to the second embodiment shown in a first step for rotating the baby carrier to the back side of the wearer.

From FIG. 4 it can be seen that, when the baby carrier is rotated/moved around the upper part of the body of the wearer, the first part 111' and the second part 112' of respective chest strap 11' are attached to the front piece in such a way that they are substantially parallel to each other, i.e. they carry, in the shown position, about the same load. More particularly, the second part 112' of respective chest strap is attached to the front piece 16', preferably by the connecting device 28', in such a way that a tangent which extends parallel to the main direction of the second part 112' forms an angle $\alpha$ of about 20° to 29°, preferably about 24°, to a horizontal plane. See FIGS. 1, 2 and 9.

Figure 5:
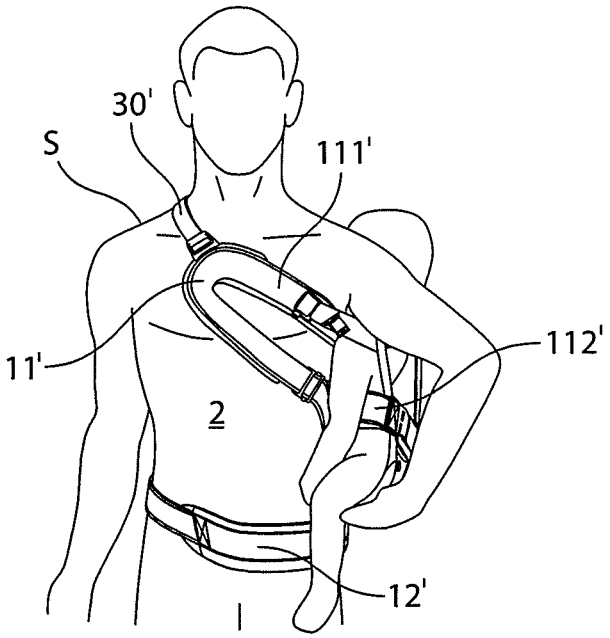
FIG. 5 is a schematic view of a wearer from the front with the carrier according to the second embodiment shown in a second step for rotating the baby carrier to the back side of the wearer.
Figure 6:
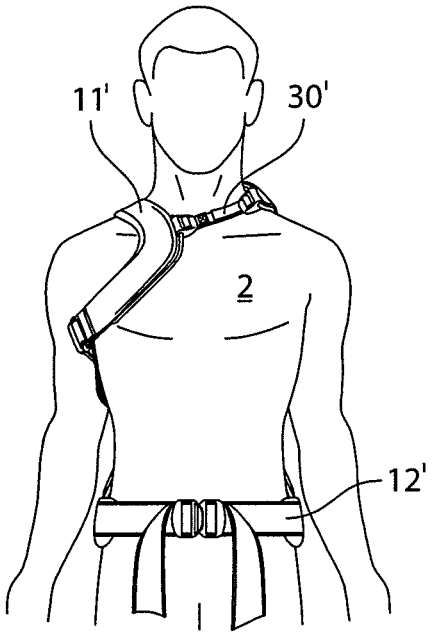
FIG. 6 is a schematic view from the front of the wearer with the baby carrier according to the second embodiment on the back and showing the connection of the two strap loops, the left arm of the carrier being not threaded through one of the strap loops.
Figure 7:
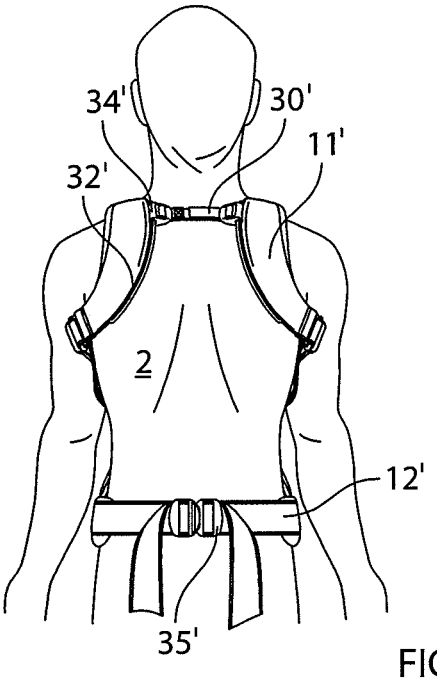
FIG. 7 is a schematic view from behind of the wearer with the baby carrier carried according to the second embodiment on the chest side.

As can be seen in FIGS. 5, 6 and 7 both chest straps 11' are connected to each other by the means 30', preferably in the form of a strap 30', which is flexible and adjustable in the longitudinal direction.

In a preferred embodiment the strap 30' is a strap 30' formed in one piece, i.e. it may not be separated into two parts by any type of detachable means. Particularly from the position shown in FIG. 5 it can be seen that the weight, which in the normal case is carried by both strap loops, is carried by, during the rotation/movement of the carrier, the strap 30' when the strap is positioned over one shoulder S of the wearer. Therefore, it is of great importance that the strap 30' may not be detachable from respective chest straps 11' nor be separable into two parts. Moreover, the chest strap 30' is preferably arranged adjustable along at least a part of the length of respective chest strap 11'. See FIG. 7. This may be achieved by an edging 32', for instance, arranged along a side portion of respective strap loop and a sliding shoe 34' adapted to fit the edging, whereby respective end of the strap is securely attached to respective sliding shoe.

Furthermore, the waist belt 12' with associated buckle 35' is formed in such a way that they facilitate the movement of the baby carrier between the chest side and the back side of the wearer and vice versa. For this purpose the inner surface of the waist belt, i.e. the surface of the waist belt directed towards the wearer, may be formed of a material with low friction. The buckle 35' of the waist belt 12' is preferably a buckle which may be divided into two pieces so as to facilitate taking on and off the baby carrier.

Figure 8:
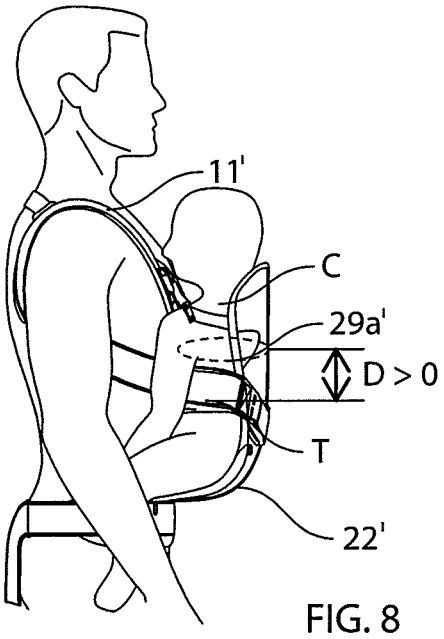
FIG. 8 is a schematic side view of the wearer with the baby carrier according to the second embodiment placed on the chest side and with a child sitting in the carrier.

In a preferred embodiment the seat support 22' is, as known, adjustably arranged in the height direction of the carrier bag 14' so that the depth of the carrier pouch 18' can be adapted to the size of the child. More particularly, as shown in FIG. 8, the seat support should be adjusted in such a way that, together with the position of the coupling device 28' on the front piece 16' and the connecting means 29' between the first part 111' and the second part 112' of respective chest strap 11', the depth of the carrier pouch is such that the centre of gravity T of the child always is located below the level of an upper edge 29*a*' of respective connecting means 29', i.e. a distance D between the centre of gravity T of the child and a schematically shown circle C, which is located at the level of the upper edge 29*a*' of respective connecting means 29', always should be greater than zero. This for securing that the child will never fall out of the baby carrier on one hand when the baby carrier is rotated/moved from the chest side to the back side of the wearer or vice versa and on the other hand when the child is sitting in the baby carrier when the baby carrier is located either on the chest side or on the back side of the wearer.

Figure 9:
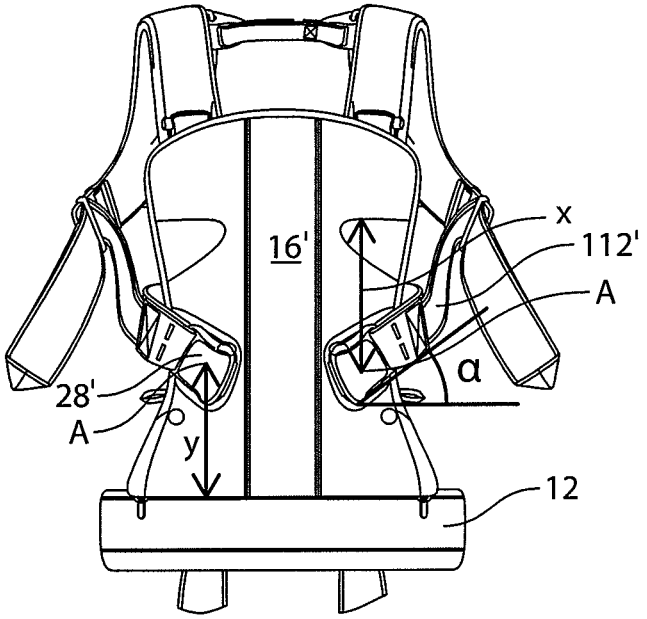
FIG. 9 is a schematic view of the baby carrier according to the second embodiment with its front piece in a plane state, FIG. 10. is a view similar to the one in FIG. 9, however with the upper portion of the front piece folded downwardly.

As can be seen from FIG. 9, in the preferred embodiment and in the plane direction of the baby carrier, a distance Y from the fastening of the front piece 16' to the waist belt 12' to a centre point A of the attachment of the connecting device 28' to the front piece 16' shall always be about 23-27 cm, preferably about 25 cm. Furthermore, a distance X between the upper attachment point (in FIG. 9 shown as a line of stitches on the outside of the front piece) for attachment of the adjustable strap 25' to the inside of the upper portion 24' and the centre point A of the attachment of the connecting device 28' to the front piece 16' shall be about 13-17 cm, preferably about 15 cm.

Figure 10:
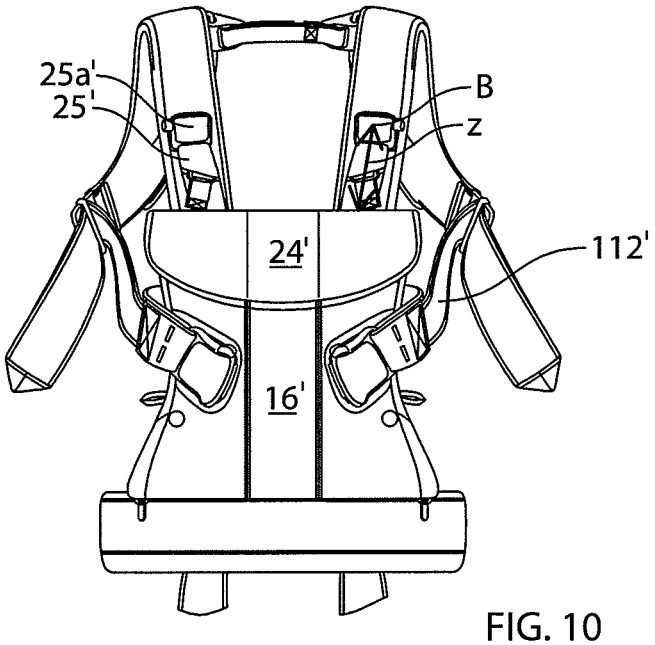

As can be seen in FIG. 10, in the plane direction of the baby carrier, a distance Z between the upper fastening point of the adjustable strap 25' at the inside of the upper portion 24' and a centre point B of the fastening of the connecting device 25*a*' to the chest strap 11' shall be about 13-17 cm, preferably about 15 cm.

Figure 11:
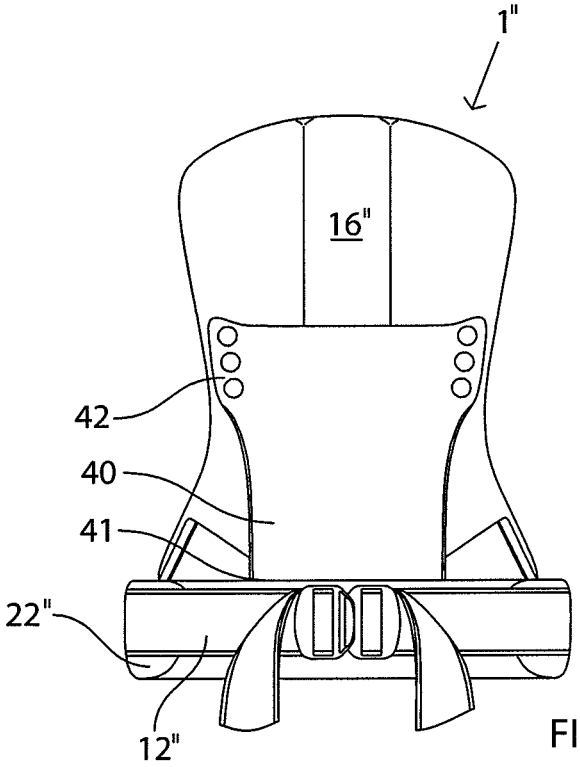
FIG. 11 is a simplified view showing only the front piece from behind, whereby the so formed carrier pouch has another construction than the one of the carrier pouch of the first and second embodiments of the baby carrier according to FIGS. 1-10.

FIG. 11 shows schematically a baby carrier 1" the carrier pouch of which is formed by the front piece 16" and a piece of fabric 40. A lower portion 41 of the piece of fabric 40 is fixed connected to the front piece 16" and/or the waist belt 12" to form a seat support 22". At least one side, at an upper portion 42 of the piece of fabric 40, is detachably connected to the front piece 16" by press buttons, for instance. In all other parts the baby carrier 1" may be shaped as the baby carrier 1 according to the first embodiment.

To be able to rotate/move the baby carrier with a child sitting in the same from the chest side to the back side of the wearer the following steps are taken:

When the child has been placed into the baby carrier on the chest side of the wearer, the wearer slips one of his/her arms under i) one chest strap 11 (in the first embodiment) or ii) first part 111' of one chest strap 11' (the second embodiment) which extends around the first shoulder, and rotates the baby carrier until that the chest strap/first part is situated fully under one arm. Thereafter the wearer slips his second arm under the second part 112;112', whereby the second chest strap is placed over the second shoulder of the wearer (FIG. 4). The strap 30;30' forms together with the two chest straps 11;11' a closed loop over the second shoulder of the wearer, which ensures that henceforth the child is sitting in a mainly upright position with the centre of gravity of the child below an imaginary circle around the child (FIG. 8). In this position the wearer may now rotate the child under his/her one arm back to the back side (FIG. 5). When the child is rotated completely to the back side of the wearer the wearer may slip one arm back through one chest strap and the other arm through the other chest strap so that the child is now sitting on the back side of the wearer and with the two chest straps of the baby carrier totally on both shoulders of the wearer. In this position the strap 30;30' is placed on the chest side of the wearer.

In all embodiments of the baby carrier 1;1';1", during the whole operation of rotation/movement, preferably the buckles 28;28', and where appropriate the buckles 25*a*', are locked to its respective parts of the carrier. The waist belt 12;12' shall always be closed during the above-mentioned rotation/movement of the carrier.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A baby carrier comprising:

chest straps having a first part and a second part, which are mutually adapted to extend around both shoulders of a wearer and are connected to each other by a connection;

a waist belt; and a carrier bag mounted to the chest straps and the waist belt, the carrier bag including a front piece, with a lower portion of the front piece being connected to the waist belt and forming a seat support, with the seat support being adjustable in a height direction, the connection between the chest straps being configured as a single piece connecting strap that is nondetachable from either of the chest straps, the single piece connecting strap being situated on a back side of the wearer when the baby carrier is carried on a chest side of the wearer, and at least the second part of the respective chest strap being detachably attached to a front side of a middle portion of the front piece by a coupling device so as to permit the baby carrier to be rotated around an upper part of the body of the wearer so as to move the baby carrier between the chest side and the back side of the wearer, such that during one step of the rotation of the baby carrier, the single piece connecting strap extends over one shoulder of the wearer and carries weight which in a normal case is carried by the chest straps, with the second part of the respective chest strap being connected to the middle portion of the front piece, and through a connecting element, to the first part at such a level relative to an upper edge of the connecting element that a centre of gravity of a child carried by the baby carrier always will be located under the upper edge of the connecting element.

2. The baby carrier according to claim 1, wherein the single piece connecting strap is flexible, and is adjustable in a longitudinal direction thereof.

3. The baby carrier according to claim 1, wherein the second part is attached to the front piece, a tangent parallel to the second part forms an angle ($\alpha$) of about 20° to 29° to a horizontal plane, such that, when rotating the baby carrier, when the single piece connecting strap extends over the shoulder of the wearer, the first part and the second part of the respective chest straps will be essentially parallel to each other and will carry essentially equally a same load.

4. The baby carrier according to claim 3, wherein the angle ($\alpha$) is about 24°.

5. The baby carrier according to claim 1, wherein a distance (Y), from a plane direction of the baby carrier, between a centre point for attachment of the second part to the front piece and the attachment of the front piece to the waist belt is about 23-27 cm.

6. The baby carrier according to claim 5, wherein the distance (Y) is about 25 cm.

7. The baby carrier according to claim 1, wherein a distance (X), from a plane direction of the baby carrier, between a centre point (A) for attachment of the second part to the front piece and an upper fastening point for a strap for attachment of the upper portion of the front piece to the respective chest strap is about 13-17 cm.

8. The baby carrier according to claim 7, wherein the distance (X) is about 15 cm.

9. The baby carrier according to claim 1, wherein a distance (Z), from a plane direction of the baby carrier, between a centre point (B) for attachment of a strap to the first part of the respective chest strap and an upper fastening point for a strap to the upper portion of the front piece is about 13-17 cm.

10. The baby carrier according to claim 9, wherein the distance (Z) is about 15 cm.

11. The baby carrier according to claim 1, wherein the single piece connecting strap that is nondetachable from either of the chest straps is inseparable into two parts.

12. The baby carrier according to claim 1, wherein a location of the single piece connecting straps relative to a location along a length of each of the chest straps is adjustable, and the single piece connecting strap is slidably attached to an edge of a respective chest strap.

13. A carrier for a baby, comprising:

a first and a second chest strap each mutually adapted to be extendable around a respective shoulder of a wearer;

a waist belt;

a carrier bag mounted to the first and the second chest straps and the waist belt, the carrier bag including a front piece, with a lower portion of the front piece being connected to the waist belt and forming a seat support, with the seat support being adjustable in a height direction, and with a part of each of the first and the second chest straps being detachably attached to a front side of a respective middle portion of the front piece by a coupling device, with said carrier being rotatable around an upper part of the body of the wearer; and a single piece connecting strap that is nondetachable from either of the first and the second chest straps, the single piece connecting strap being (i) fixed to respective upper portions of each of the first and the second chest straps and (ii) configured to support at least the carrier and the baby when the carrier is rotated, with a location of the single piece connecting strap relative to a location along a length of each of the first and the second chest straps being adjustable, with the single piece connecting strap being slidably attached to an edge of a respective chest strap, and with the part of the respective chest strap being connected to the middle portion of the front piece, and through a connecting element, to the first part at such a level relative to an upper edge of the connecting element that a centre of gravity of a child carried by the baby carrier always will be located under the upper edge of the connecting element.

14. The carrier according to claim 13, wherein the single piece connecting strap is configured to support at least the carrier and the baby by extending over one of the shoulders of the wearer when the carrier is rotated.

15. The carrier according to claim 14, wherein the single piece connecting strap is configured to support at least the carrier and the baby by extending over one of the shoulders of the wearer when the carrier is rotated between a chest side and a back side of the wearer, or between the back side and the chest side of the wearer.

16. The carrier according to claim 13, wherein the single piece connecting strap is flexible.

* * * * *